US012628898B2

(12) United States Patent
Ishikawa

(10) Patent No.: US 12,628,898 B2
(45) Date of Patent: May 19, 2026

(54) HELMET AND CHIN STRAP

(71) Applicant: SHOEI Co., Ltd., Tokyo (JP)

(72) Inventor: Kyosuke Ishikawa, Tokyo (JP)

(73) Assignee: SHOEI Co., Ltd., Tokyo (JP)

( * ) Notice: Subject to any disclaimer, the term of this patent is extended or adjusted under 35 U.S.C. 154(b) by 134 days.

(21) Appl. No.: 18/693,633

(22) PCT Filed: Sep. 21, 2022

(86) PCT No.: PCT/JP2022/035133

§ 371 (c)(1),
(2) Date: Mar. 20, 2024

(87) PCT Pub. No.: WO2023/048173

PCT Pub. Date: Mar. 30, 2023

(65) Prior Publication Data

US 2024/0389702 A1 Nov. 28, 2024

(30) Foreign Application Priority Data

Sep. 24, 2021 (JP) ..... 2021-155125

(51) Int. Cl.
*A42B 3/08* (2006.01)

(52) U.S. Cl.
CPC ..... *A42B 3/08* (2013.01)

(58) Field of Classification Search
CPC ..... A42B 3/08; D03D 1/0094; D03D 3/005
See application file for complete search history.

(56) References Cited

U.S. PATENT DOCUMENTS

| | | | | |
|---|---|---|---|---|
| 9,719,196 | B2 | 8/2017 | Salama et al. | |
| 10,568,378 | B2 * | 2/2020 | Von Dunten | D03D 1/0094 |
| 12,351,951 | B2 * | 7/2025 | Morgis | D03D 15/47 |
| 2011/0315180 | A1 | 12/2011 | Kanayama | |
| 2013/0219597 | A1 | 8/2013 | Van Waes | |

FOREIGN PATENT DOCUMENTS

| | | | |
|---|---|---|---|
| JP | H10-211863 | A | 8/1998 |
| JP | 2004-137635 | A | 5/2004 |
| JP | 2010-203223 | A | 9/2010 |
| JP | 2013-536903 | A | 9/2013 |

(Continued)

OTHER PUBLICATIONS

International Search Report dated Nov. 22, 2022, in connection with International Application No. PCT/JP2022/035133.

(Continued)

*Primary Examiner* — Tajash D Patel
(74) *Attorney, Agent, or Firm* — Wolf, Greenfield & Sacks, P.C.

(57) ABSTRACT

This helmet includes a cap body and a chin strap that is arranged on the inner side of the cap body. The chin strap is woven into a strap shape using weft threads and warp threads. The warp threads include a first warp thread constituted by a first fiber, and a second warp thread constituted by a second fiber, which is made of ultra high molecular weight polyethylene. The tensile strength and the elastic modulus of the second fiber are greater than those of the first fiber. The weft threads are constituted by the first fiber.

7 Claims, 6 Drawing Sheets

(56) References Cited

FOREIGN PATENT DOCUMENTS

| | | | | |
|---|---|---|---|---|
| WO | WO-2019197000 A1 * | 10/2019 | ..... | A61G 7/10 |
| WO | WO-2020251381 A1 * | 12/2020 | ..... | A42B 3/08 |

OTHER PUBLICATIONS

Office action issued on Dec. 5, 2023, in the corresponding Japanese Patent Application No. 2021-155125 and machine translation thereof.
Japanese Office Action drafted Aug. 15, 2024, in connection with Japanese Application No. 2021-155125, with English translation thereof.

* cited by examiner

| Sample No. | Image | First Fibers 20A /Second Fibers 20B In Warps (Numbers) Surface Area Percentage Of Second Fibers 20B (%) | Static Friction Coefficient | Kinetic Friction Coefficient |
|---|---|---|---|---|
| A |  | 129/0<br>0 | 0.193 | 0.165 |
| B |  | 123/6<br>6.0 | 0.177 | 0.159 |
| C |  | 119/10<br>9.9 | 0.184 | 0.159 |
| D |  | 117/12<br>11.8 | 0.177 | 0.157 |
| E |  | 105/24<br>23.0 | 0.190 | 0.163 |
| F |  | 97/32<br>30.1 | 0.176 | 0.153 |
| G |  | 81/48<br>43.6 | 0.172 | 0.132 |
| H |  | 52/77<br>65.9 | 0.148 | 0.106 |

First Warps 20A: 1100 dtex x 2 twists, Density 1.38 g/cm$^3$

Second Warps 20B: 1320 dtex x 2 twists, Density 0.97 g/cm$^3$

| Sample No. | Image | First Fibers 20A /Second Fibers 20B In Warps (Numbers) Surface Area Percentage Of Second Fibers 20B (%) | Kinetic Friction Coefficient |
|---|---|---|---|
| A |  | 129/0<br>0 | 0.239 |
| B |  | 123/6<br>6.0 | 0.244 |
| C |  | 119/10<br>9.9 | 0.246 |
| D |  | 117/12<br>11.8 | 0.241 |
| E |  | 105/24<br>23.0 | 0.244 |
| F |  | 97/32<br>30.1 | 0.234 |
| G |  | 81/48<br>43.6 | 0.218 |
| H |  | 52/77<br>65.9 | 0.190 |

First Warps 20A: 1100 dtex x 2 twists, Density 1.38 g/cm$^3$
Second Warps 20B: 1320 dtex x 2 twists, Density 0.97 g/cm$^3$

HELMET AND CHIN STRAP

CROSS REFERENCE TO RELATED APPLICATIONS

This Application is a national stage filing under 35 U.S.C. 371 of International Patent Application Serial No PCT/JP2022/035133, filed Sep. 21, 2022, which claims priority to Japanese application number 2021-155125, filed Sep. 24, 2021. The entire contents of these applications are incorporated herein by reference in their entirety.

TECHNICAL FIELD

The present disclosure relates to a helmet and a chin strap.

BACKGROUND ART

A helmet for a motorcycle includes two chin straps attached to the inner side of a helmet body. The chin straps are attached to the helmet body by chin strap clips (refer to, for example, Patent Literature 1). The length of the chin straps is adjusted by a strap length adjuster. This allows the chin straps to keep the helmet body on the head of a wearer.

CITATION LIST

Patent Literature

Patent Literature 1: Japanese Laid-Open Patent Publication No. 2004-137635

SUMMARY OF INVENTION

Technical Problem

The chin straps need to keep the helmet body worn on the head of the wearer in case of an emergency in which a strong load is applied to the helmet body. It is desirable that the chin straps to be resistant to tensile loads and not be stretched in order to keep the helmet body on the head of the wearer so that the impact absorbing properties of the helmet can be exhibited further properly in case of an emergency.

The chin straps can be more resistant to tensile loads so as not to be stretched by, for example, increasing the width or thickness of the chin straps to largen the chin straps. However, largened chin straps will increase weight and decrease flexibility.

Solution to Problem

In one general aspect of the present disclosure, a helmet including a helmet body and a chin strap arranged at an inner side of the helmet body is provided. The chin strap is woven with wefts and warps to be strap-shaped. The warps include a first warp formed by a first fiber and a second warp formed by a second fiber of ultrahigh molecular weight polyethylene. The second fiber has a higher tensile strength and a higher elastic modulus than the first fiber. The wefts are each formed by the first fiber.

In another general aspect of the present disclosure, a chin strap arranged at an inner side of a helmet body of a helmet is provided. The chin strap is woven with wefts and warps to be strap-shaped. The warps include a first warp formed by a first fiber and a second warp formed by a second fiber of ultrahigh molecular weight polyethylene. The second fiber has a higher tensile strength and a higher elastic modulus than the first fiber. The wefts are each formed by the first fiber.

DESCRIPTION OF EMBODIMENTS

A helmet according to one embodiment will now be described with reference to the drawings. In the description that refers to FIG. 1, the frame of reference for the frontward, rearward, leftward, rightward, upward, and downward directions will be based on a wearer of the helmet.

Figure 1:
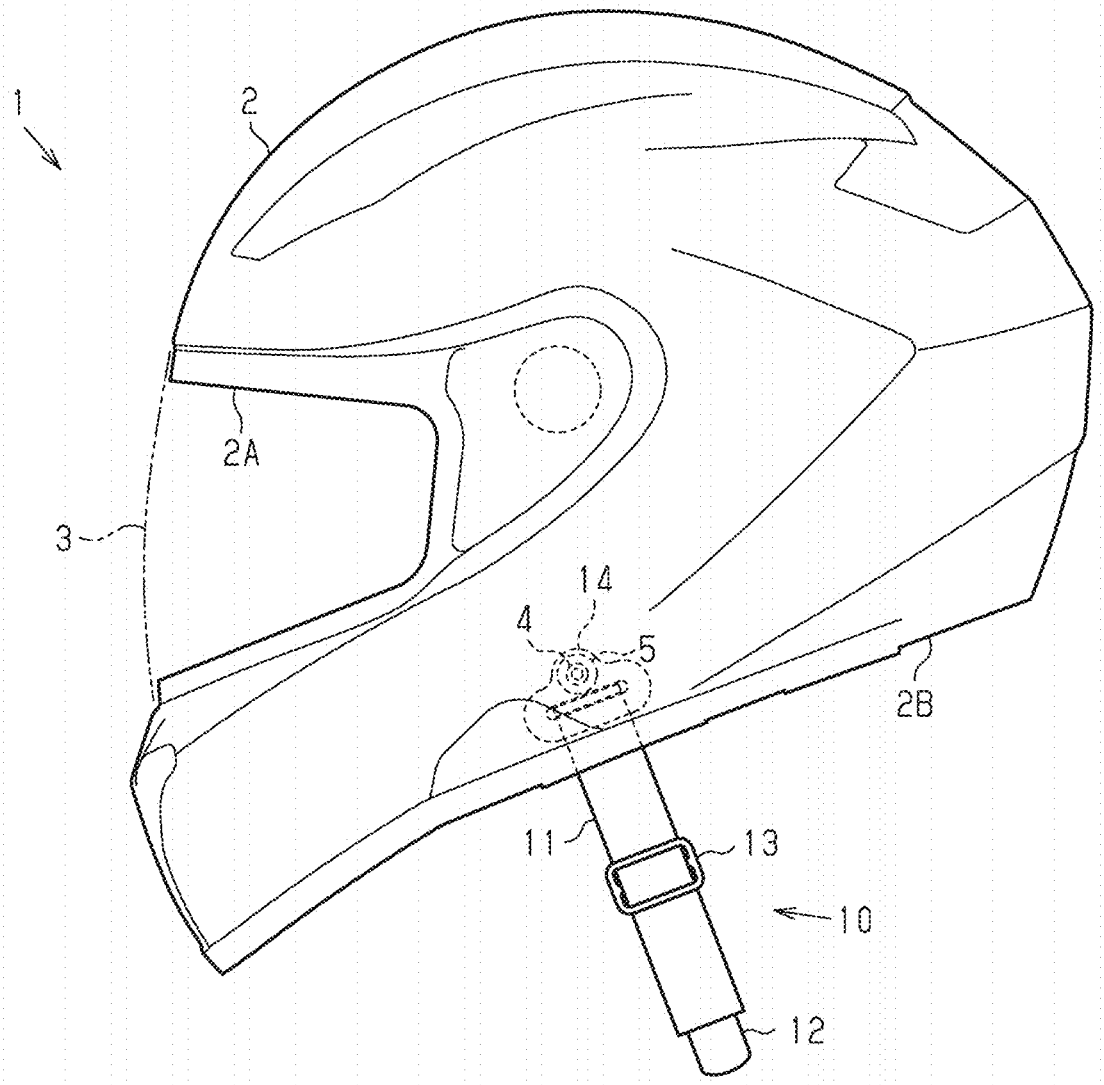
FIG. 1 is a side view of a helmet.

As shown in FIG. 1, a helmet 1 is a full-face helmet. The helmet 1 includes a helmet body 2 and two chin strap units 10. The two chin strap units 10 are respectively arranged on the left side and the right side of the helmet 1. The helmet body 2 forms the shell of the helmet 1. The helmet body 2 is a hemispherical plastic member. The inside of the helmet body 2 includes, for example, an impact absorbing member made from resin foam (such as styrene foam), an interior pad made from urethane foam, and the like.

The helmet body 2 includes a first opening 2A and a second opening 2B. The first opening 2A is formed in a frontward region of the helmet body 2. The first opening 2A provides the wearer with a field of view. A light-transmissive shield 3 is arranged over the first opening 2A. The second opening 2B is formed in a downward region of the helmet body 2. The head of the wearer is fitted through the second opening 2B.

The two chin strap units 10 each include a chin strap 11, a coupling member 12, a strap length adjuster 13, and a chin strap clip 14. The chin strap 11 is a strap member formed by weaving chemical fiber filaments. The chin strap 11 includes a first end attached to the helmet body 2 by the chin strap clip 14 and a second end extending out of the second opening 2B.

The coupling member 12 is arranged at the second end of the chin strap 11. The coupling member 12 is, for example, a one-touch ratchet buckle. Specifically, one of the two chin strap units 10 includes a ratchet, which is one example of the coupling member 12, at the second end of the chin strap 11. The other one of the two chin strap units 10 includes a buckle, which is one example of the coupling member 12, at the second end of the chin strap 11. The ratchet is inserted into the buckle to couple the ratchet and the buckle and connect the two chin strap units 10 to each other.

The strap length adjuster 13 adjusts the length of the portion of the chin strap 11 extending out of the second opening 2B. In one example, the strap length adjuster 13 is a ring-shaped tightener such as a slide ring or a D-ring. In the present embodiment, the strap length adjuster 13 is a slide ring. The strap length adjuster 13 includes a frame with a rod partitioning the inner side of the frame into two regions that define two holes arranged next to each other in a direction in which the chin strap 11 extends. The chin strap 11 is inserted through the two holes of the strap length adjuster 13. The strap length adjuster 13 may be arranged on only one of the two chin strap units 10 or on both of the two chin strap units 10. The slide ring or the like is typically made of stainless steel such as SUS304.

The chin strap clips 14 are respectively fixed to the left and right sides of the inner surface of the helmet body 2 by fixing members 4. In one example, the fixing members 4 are screws or rivets. Each chin strap clip 14 includes a fixing hole through which the fixing member 4 is inserted and an insertion hole through which the chin strap 11 is inserted. The chin strap clip 14 is fixed to the helmet body 2 by swaging the fixing member 4 in a state in which the stem of the fixing member 4 is inserted through the fixing hole and an attaching hole, which extends through the helmet body 2.

Chin Strap

Figure 2:
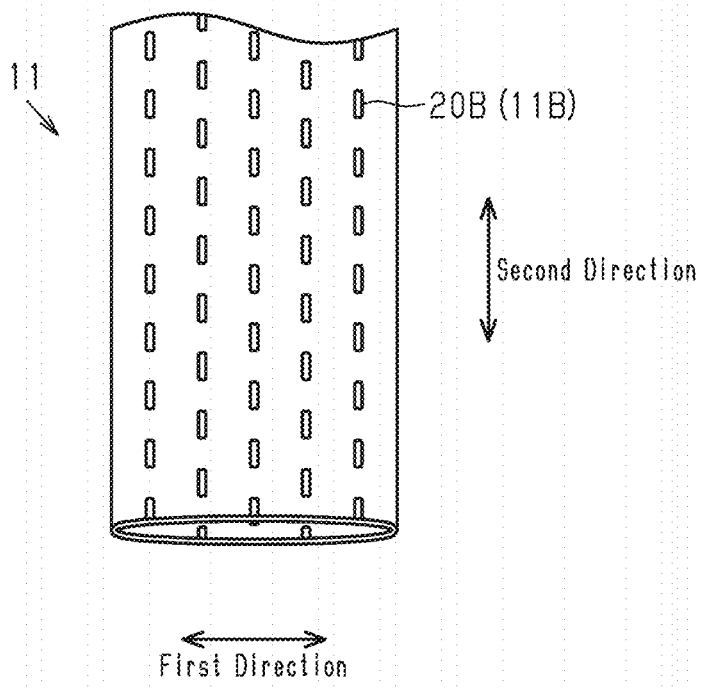
FIG. 2 is a perspective view showing a main part of a chin strap used in the helmet shown in FIG. 1.

As shown in FIG. 2, the chin strap 11 is formed by tubular-weaving multiple types of chemical fibers into a strap. The chin strap 11 that is tubular-weaved is sleeve-shaped. The chin strap 11 has no strap member or the like in the sleeve that would increase the strength to resist a tensile load. This simplifies the structure of the chin strap 11 and allows the chin strap 11 to be flexible. As will be described below, resistance to a tensile load is obtained by including second warps 20B when weaving the chin strap 11. The structure of the chin strap 11 will now be described in detail with reference to FIG. 3.

Figure 3:
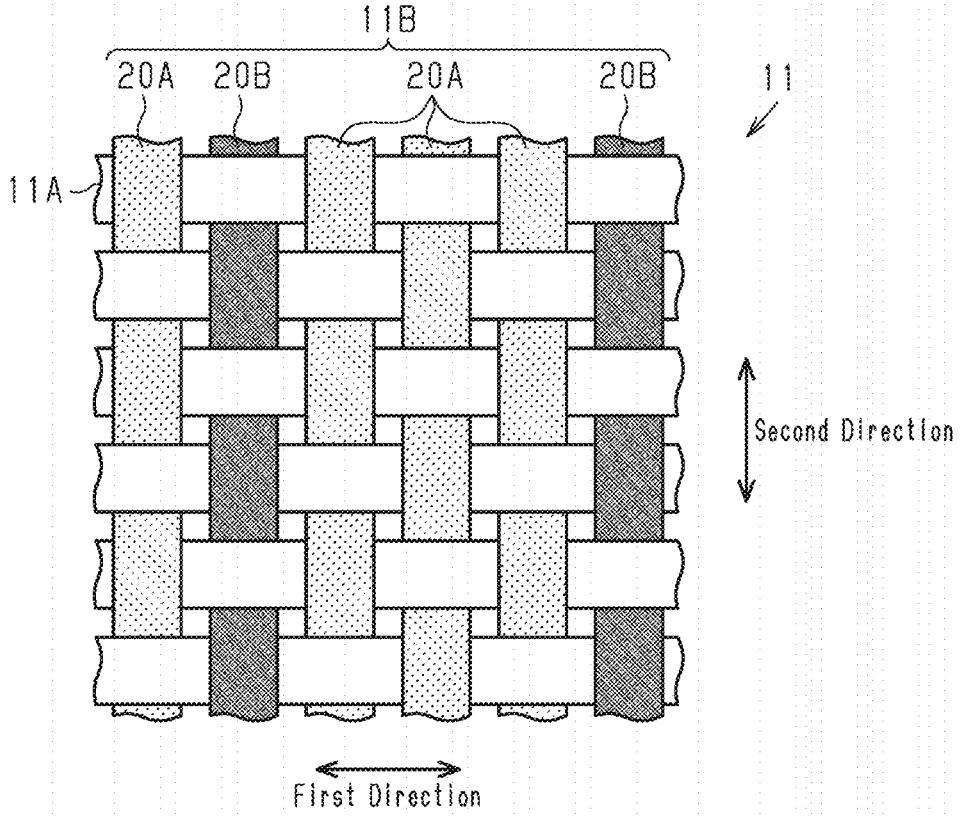
FIG. 3 is a schematic view showing the fabric structure of the chin strap used in the helmet shown in FIG. 1.

As shown in FIG. 3, the chin strap 11 is formed by weaving multiple wefts 11A and multiple warps 11B.

The wefts 11A extend in a first direction of the chin strap 11. The first direction corresponds to the width direction of the chin strap 11. Each weft 11A is formed by a yarn member obtained by twisting together first fibers of polyester. In one example, the yarn member is formed by twisting two fibers. The first fibers of polyester, which are an example of chemical fibers, are water- and sunlight-resistant and have superior weather resistance.

The warps 11B extend in a second direction of the chin strap 11. The second direction corresponds to the longitudinal direction of the chin strap 11. The first direction can also be referred to as the transverse direction of the chin strap 11. The warps 11B include first warps 20A and second warps 20B. In one example, the warps 11B include more first warps 20A than second warps 20B.

In the same manner as the wefts 11A, each first warp 20A is formed by a yarn member obtained by twisting together first fibers of polyester. Each second warp 20B is formed by a yarn member obtained by twisting second fibers of ultra-high molecular weight polyethylene. In one example, the first warps 20A and the second warps 20B may have the same size or a different size.

In one example, the first warps 20A and the second warps 20B are each formed by twisting two fibers. The first fibers of the wefts 11A and the first warps 20A are, for example, Tetoron (registered trademark), which is one example of a polyester. The second fibers of the second warps 20B are, for example, Izanas (registered trademark), which is one example of an ultrahigh molecular weight polyethylene.

The second fibers of ultrahigh molecular weight polyethylene are an example of chemical fibers and are superior to the first fibers in mechanical characteristics, with a higher tensile strength and a higher elastic modulus, in addition to having superior weather resistance. The first fibers are softer and have a better feel on the skin than the second fibers.

The second warps 20B are arranged at equal intervals in, for example, the first direction. In one example, the chin strap 11 is sleeve-shaped so that the second warps 20B are arranged at equal intervals in its two opposing surfaces. In FIG. 3, three first warps 20A are arranged between the second warps 20B. Instead, the chin strap 11 may have twenty, ten, eight, three, or two first warps 20A arranged between two adjacent second warps 20B throughout the entire surface.

How to Wear Helmet

When wearing the helmet 1, the wearer first fits his or her head into the helmet body 2 from the second opening 2B. Then, the wearer couples together the coupling members 12 of the two chin strap units 10 below the chin to connect the two chin strap units 10. This completes the fitting of the helmet 1. The length of the chin straps 11 is adjusted by the strap length adjusters 13.

Relationship of Stretch of Chin Strap and Content of Second Fibers in Warps

Since the chin strap 11 includes the second warps 20B in the warps 11B, the chin strap 11 resists stretching when a load is applied to the helmet body 2 in a direction in which the helmet body 2 is dislodged from the head of the wearer.

In the entire chin strap unit 10, when load is applied to the helmet body 2 in the direction in which the helmet body 2 is dislodged from the head of the wearer, the chin strap 11 inserted through the strap length adjuster 13 may be pulled against the frictional force produced with the strap length adjuster 13 thus increasing the length of the portion of the chin strap 11 extending out of the second opening 2B. In addition to having the above-described characteristics, the second fibers of the second warps 20B are more slippery than the first fibers of the first warps 20A and the wefts 11A. Thus, although the second warps 20B have to resist stretching of the chin strap 11 when a tensile load is applied, if the area of the second warps 20B exposed from the surface is too large, the static friction coefficient and the kinetic friction coefficient of the chin strap 11 with respect to the strap length adjuster 13 will be too small. Thus, it is preferred that the area of the second warps 20B exposed from the surface be such that the friction coefficient of the chin strap 11 relative to the strap length adjuster 13 does not decrease excessively.

Changes in the static friction coefficient and the kinetic friction coefficient were checked when changing the surface area percentages of the second warps 20B and the first warps 20A in the warps 11B to determine the appropriate percentage of the second warps 20B and the first warps 20A. The static friction coefficient is an index of the force holding the strap length adjuster 13 of the chin strap 11 tightened by the strap length adjuster 13 (initial load when chin strap 11 starts slipping). The kinetic friction coefficient is an index of the capacity to stop the chin strap 11 that starts slipping with respect to the strap length adjuster 13 (braking force applied to chin strap 11 when chin strap 11 starts slipping). The surface area percentage is the ratio of the surface area of the second warps 20B in the warps 11B.

Figure 4:
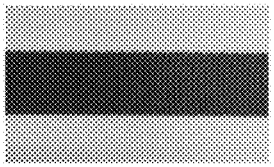
FIG. 4 is a diagram showing the relationship of the surface area percentage of second warps in warps and the static friction coefficient and kinetic friction coefficient of a chin strap relative to a surface plate.
Figure 4:
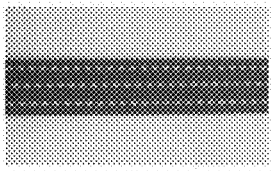
Figure 4:
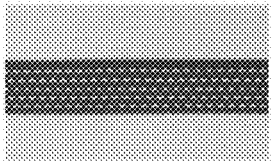
Figure 4:
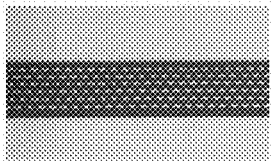
Figure 4:
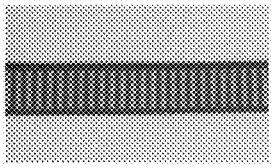
Figure 4:
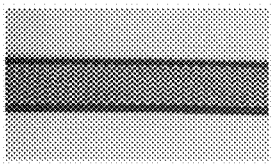
Figure 4:
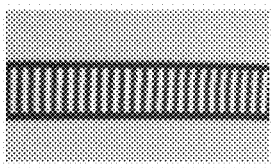
Figure 4:
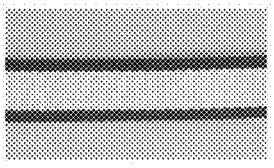

FIG. 4 is a diagram showing the relationship of the surface area percentage of the second warps 20B in the warps 11B and the static friction coefficient and kinetic friction coefficient of the chin strap 11 relative to a surface plate.

Surface area percentage of sample A: 0% (sample does not include second fibers 20B)

Surface area percentage of sample B: 6.0% (sample includes second fibers 20B)

Surface area percentage of sample C: 9.9% (sample includes second fibers 20B)

Surface area percentage of sample D: 11.8% (sample includes second fibers 20B)

Surface area percentage of sample E: 23.0% (sample includes second fibers 20B)

Surface area percentage of sample F: 30.1% (sample includes second fibers 20B)

Surface area percentage of sample G: 43.6% (sample includes second fibers 20B)

Surface area percentage of sample H: 65.9% (sample includes second fibers 20B)

In this case, the surface area percentage is calculated as follows.

When a pre-twisted fiber (raw filament) is considered to be a single cylinder, the cross-sectional area A ($mm^2$) of the single fiber is expressed by Equation (1), where X represents the fiber diameter (dtex) and ρ represents the fiber density ($g/cm^3$), In this case, 1 dtex is the weight (g) per unit length 10000 m of the fiber.

$$A = \frac{X}{\rho \times 10000} \tag{1}$$

The fiber circumference L (mm) is expressed by Equation (2), where D represents the fiber diameter (mm).

$$L = \pi \times D = \pi \times \sqrt{\frac{4 \times A}{\pi}} = 2 \times \sqrt{\pi \times A} \tag{2}$$

Then, the surface area $S_1$ of the first fiber and the surface area $S_2$ of the second fiber per unit length in the second direction are calculated using the fiber circumference L (mm). For example, in a unit length of 1 mm in the second direction, the surface area $S_1$ ($mm^2$) of the first fiber is expressed as $S_1=L_1$, where $L_1$ represents the circumference of the first fiber. Likewise, in a unit length of 1 mm in the second direction, the surface area $S_2$ ($mm^2$) of the second fiber is expressed as $S_2=L_2$, where $L_2$ represents the circumference of the second fiber.

The surface area percentage $S_r$ (%) of the second warps 20B in the warps 11B is expressed by Equation (3), where $S_{T1}$ represents the total surface area of the first warps 20A and $S_{T2}$ represents the total surface area of the second warps 20B in the warps 11B. The total surface area $S_{T1}$ of the first warps 20A in the warps 11B is expressed by Equation (4), where $S_1$ represents the surface area of the first fiber, $a_1$ represents the number of the first fibers (number of twists) forming the first warps 20A, and $b_1$ represents the number of the first warps 20A in the warps 11B. Likewise, the total sum $S_{T2}$ of the surface areas of the second warps 20B in the warps 11B is expressed by Equation (5), where $S_2$ represents the surface area of the second fiber, $a_2$ represents the number of the second fibers (number of twists) forming the second warp 20B, and $b_2$ represents the number of the second warps 20B in the warps 11B.

$$S_r = \frac{S_{T2}}{S_{T1} + S_{T2}} \tag{3}$$

$$S_{T1} = \frac{1}{2} \times S_1 \times a_1 \times b_1 \tag{4}$$

$$S_{T2} = \frac{1}{2} \times S_2 \times a_2 \times b_2 \tag{5}$$

When calculating the surface area percentage $S_r$ of the second warps 20B in the warps 11B, the areas of the first warps 20A and the second warps 20B covered by the wefts 11A are ignored. With respect to Equations (4) and (5), the chin strap 11 is sleeve-shaped. Thus, the surface area $S_1$ of the first fiber and the surface area $S_2$ of the second fiber are multiplied by ½ to obtain only the areas of the outer surface of the sleeve.

The first warps 20A used in Samples A to H were formed by twisting two first fibers. The first fibers used in Samples A to H had a fiber diameter D of 1100 dtex and a density ρ of 1.38 $g/cm^3$. The second warps 20B used in Samples A to H were formed by twisting two second fibers. The second fibers used in Samples A to H had a fiber diameter D of 1320 dtex and a density ρ of 0.97 $g/cm^3$.

Figure 5:
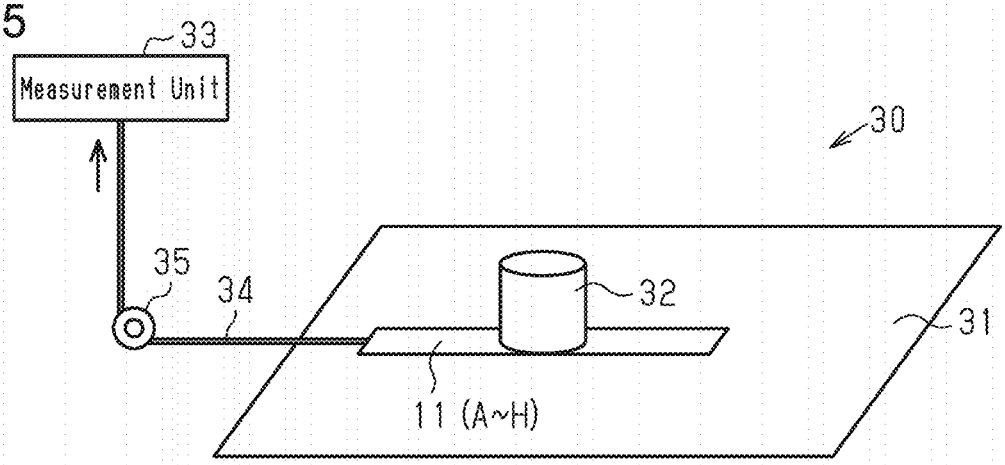
FIG. 5 is a perspective view of a tensile testing machine that measures the static friction coefficient and the kinetic friction coefficient shown in FIG. 4.

Further, the static friction coefficient and the kinetic friction coefficient of Samples A to H relative to the surface plate were measured with a tensile testing machine 30 such as that shown in FIG. 5. The tensile testing machine 30 includes a surface plate 31 on which Samples A to H are placed, a weight 32 placed on Samples A to H, a measurement unit 33 that measures the frictional force of Samples A to H acting on the surface plate 31, a connection thread 34 that connects the measurement unit 33 and Samples A to H, and a pulley 35.

Specific conditions were as follows.

Tensile Testing Machine: Minebea TG-50 kN

Surface Plate: UNI SEIKI U-9090

Test Speed: 100 mm/min

Test End Point (displacement): 60 mm

Sample Length: 25 cm

Weight Mass: 2 kg

Normal Force Generated by Weight Mass: 19.6 N

Friction Coefficient=Frictional Force (N)/Normal Force (N)

Then, the static friction coefficient and the kinetic friction coefficient were calculated using the frictional force and the normal force generated by the weight mass. Four specimens of each of Samples A to H were tested, and the average value was used as the static friction and the dynamic friction.

Figure 6:
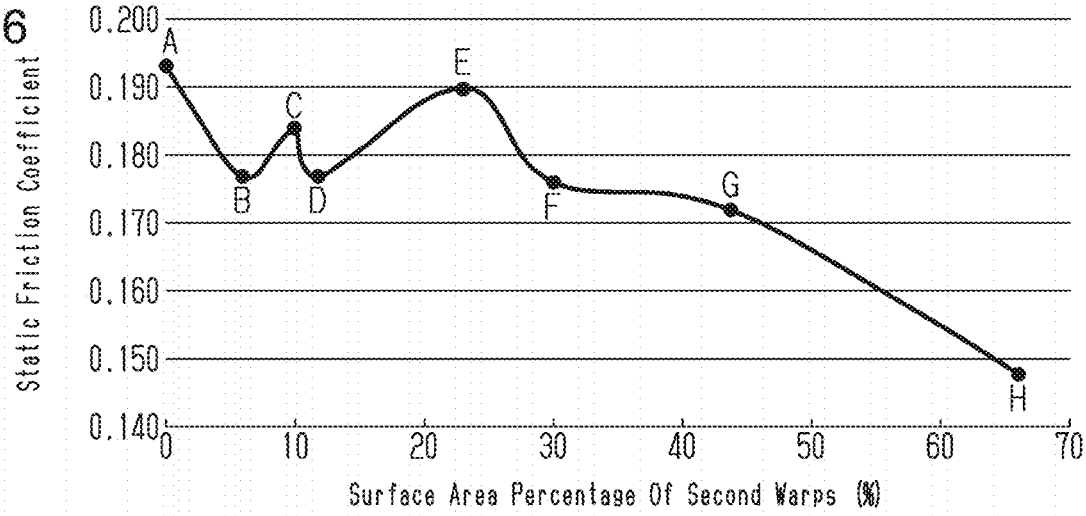
FIG. 6 is a graph showing the relationship of the surface area percentage of the second warps in Samples A to H and the static friction coefficient of Samples A to H relative to the surface plate.

FIG. 6 shows the relationship of the surface area percentage of the second warps 20B in Samples A to H and the static friction coefficient of Samples A to H relative to the surface plate 31. As shown in FIG. 6, the static friction coefficients of Samples A to G were in a range of 0.193 to 0.172 (maximum range). However, when the surface area percentage became greater than 43.6%, which is the surface area percentage of Sample G, the static friction coefficient decreased in an outstanding manner. Thus, it is preferred that the surface area percentage of the second warps 20B in the warps 11B of the chin strap 11 be 43.6% or less to limit decreases in the static friction coefficient. This will limit slipping of the chin strap 11 on the slide ring through which the chin strap 11 is inserted. That is, the holding force of the chin strap 11 in the strap length adjuster 13 will be increased.

Figure 7:
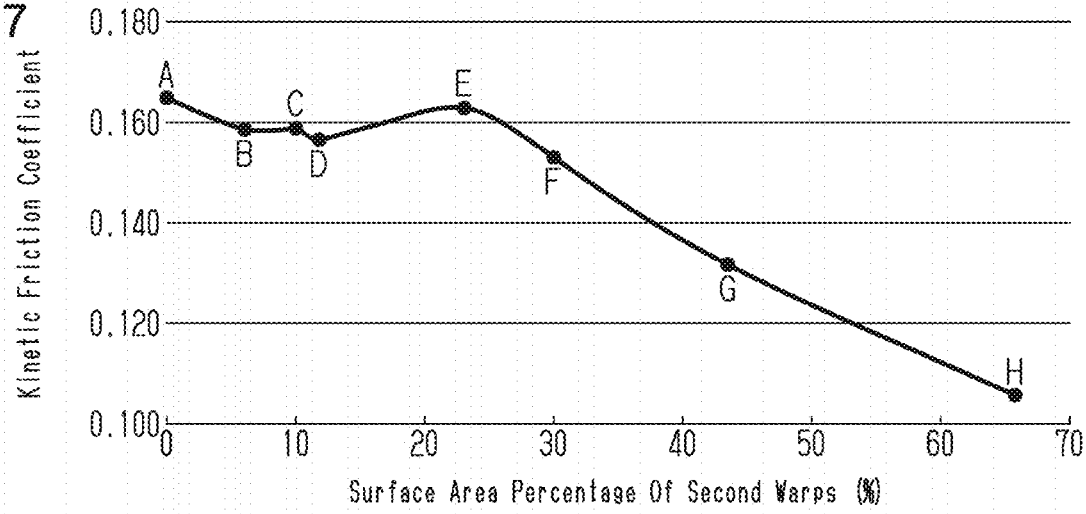
FIG. 7 is a graph showing the relationship of the surface area percentage of the second warps in Samples A to H and the kinetic friction coefficient of Samples A to H relative to the surface plate.

FIG. 7 shows the relationship of the surface area percentage of the second warps 20B in Samples A to H and the kinetic friction coefficient of Samples A to H relative to the surface plate 31. As shown in FIG. 7, the kinetic friction coefficients of Samples A to E were in a range of 0.165 to 0.157 (maximum range). However, when the surface area percentage became greater than 23.0%, which is the surface area percentage of Sample E, the kinetic friction coefficient decreased in an outstanding manner when the surface area percentage increased. Thus, it is preferred that the surface area percentage of the second warps 20B in the warps 11B of the chin strap 11 be 23.0% or less to limit decreases in the kinetic friction coefficient. This provides enough friction to easily stop the slide ring through which the chin strap 11 is inserted from moving.

In the test described above, the static friction coefficient and the kinetic friction coefficient of the chin strap 11 relative to the surface plate 31 were calculated. With respect to the chin strap unit 10, the frictional force between the chin strap 11 and the slide ring forming the strap length adjuster 13 should be taken into consideration. In general, frictional force will increase as a portion in contact with a subject surface (real contact area) increases. The real contact area will decrease as the hardness of two surfaces in contact increases. The real contact area will increase as the hardness of the two surfaces in contact decreases. In the above test, the surface plate 31, which is made of cast iron, is used as a subject surface that contacts the chin strap 11. In contrast, the strap length adjuster 13 is typically made of stainless steel (for example, SUS304) regardless of whether the strap length adjuster 13 is a D-ring or a slide ring. The cast iron and the stainless steel are different metals but have substantially the same the hardness (Brinell hardness: converted to HBW), with cast iron being 160 to 180 HB, and SUS304 being 187 HB. Thus, it can be assumed that the static friction coefficient and the kinetic friction coefficient of the friction between the chin strap 11 and the D-ring or the slide ring will have substantially the same tendency as the static friction coefficient and the kinetic friction coefficient of the friction between the chin strap 11 and the surface plate 31.

Figure 8:
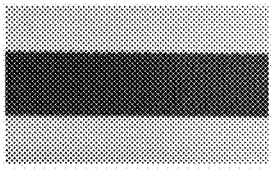
FIG. 8 is a diagram showing the relationship of the surface area percentage of the second warps in warps and the kinetic friction coefficient of a chin strap relative to a slide ring.
Figure 8:
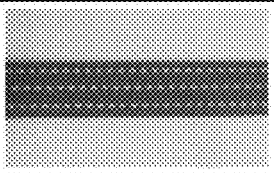
Figure 8:
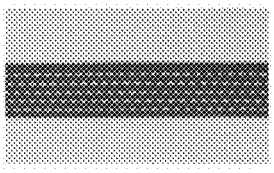
Figure 8:
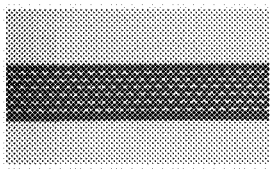
Figure 8:
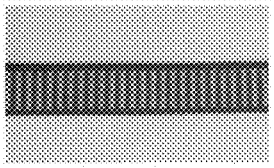
Figure 8:
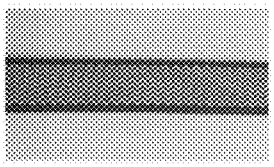
Figure 8:
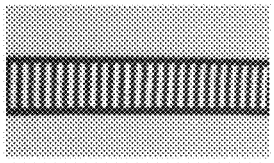
Figure 8:
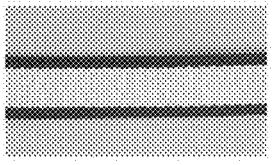

This assumption was confirmed by checking the relationship of the surface area percentage of the second warps 20B in the warps 11B and the kinetic friction coefficient of the chin strap 11 relative to the slide ring. In this case, the slide ring is an example of the strap length adjuster 13. FIG. 8 is a diagram showing the relationship of the surface area percentage of the second warps 20B in the warps 11B and the kinetic friction coefficient of the chin strap 11 relative to the slide ring.

Figure 9:
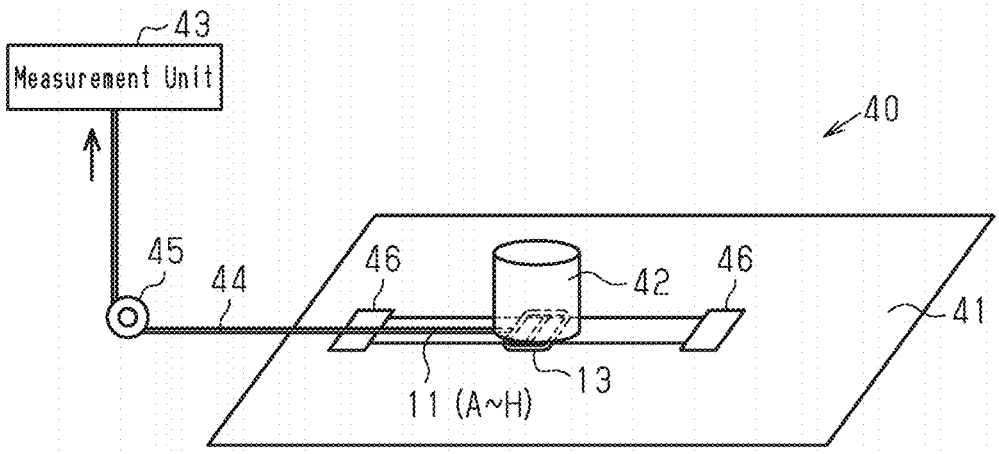
FIG. 9 is a perspective view showing the structure of a tensile testing machine that measures the kinetic friction coefficient shown in FIG. 8.

FIG. 9 is a perspective view of a tensile testing machine 40. The tensile testing machine 40 includes a surface plate 41 on which Samples A to H are placed, a slide ring that is an example of the strap length adjuster 13 and placed on Samples A to H, a weight 42 formed integrally with the slide ring, a measurement unit 43 that measures the frictional force of Samples A to H, a connection thread 44, and a pulley 45. The connection thread 44 connects the slide ring and the measurement unit 43. Further, the ends of Samples A to H are fixed to the surface plate 41 by fixing members 46 such as adhesive tape. The specific conditions and the testing procedures were the same as the test using the tensile testing machine 30 shown in FIG. 5.

Figure 10:
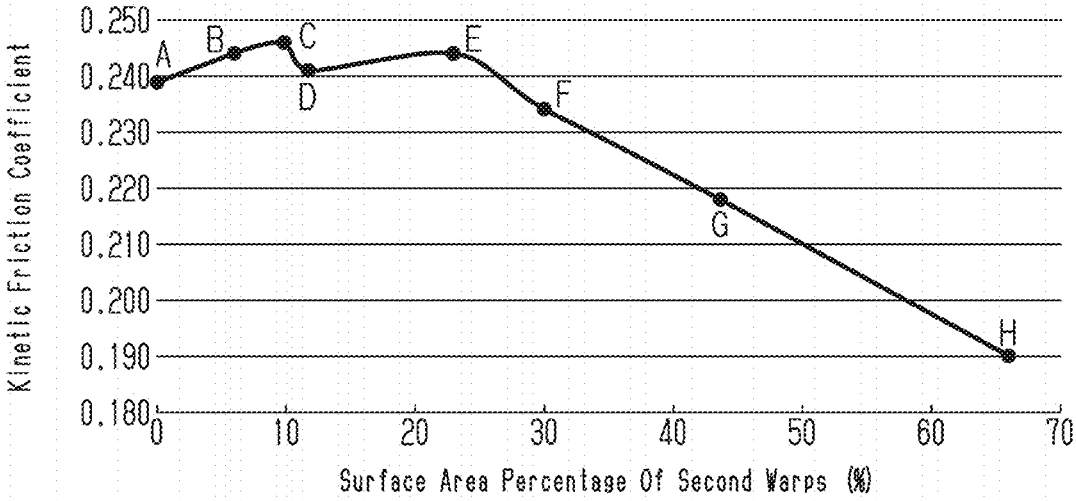
FIG. 10 is a graph showing the relationship of the surface area percentage of the second warps in warps and the kinetic friction coefficient of Samples A to H relative to a slide ring.

FIG. 10 shows the relationship of the surface area percentage of the second warps 20B in Samples A to H and the kinetic friction coefficient of Samples A to H relative to the slide ring. In this case, the slide ring is an example of the strap length adjuster 13. As shown in FIG. 10, the kinetic friction coefficients of Samples A to E were in a range of 0.246 to 0.239 (maximum range). However, when the surface area percentage became greater than 23.0%, which is the surface area percentage of Sample E, the kinetic friction coefficient decreased in an outstanding manner as the surface area percentage increased. That is, the relationship of the surface area percentage of the second warps 20B and the kinetic friction coefficient of the chin strap 11 relative to the slide ring had the same tendency as the relationship of the surface area percentage of the second warps 20B and the kinetic friction coefficient of the chin strap 11 relative to the surface plate 31. Thus, the relationship of the surface area percentage of the second warps 20B and the static friction coefficient of the chin strap 11 relative to the slide ring is considered to have the same tendency as the relationship of the surface area percentage of the second warps 20B and the static friction coefficient of the chin strap 11 relative to the surface plate 31.

Advantages of Embodiment

The above embodiment has the following advantages.

(1) In the chin strap 11, the warps 11B include the first warps 20A and the second warps 20B so that the second warps 20B reduce stretching of the chin strap 11 and the first warps 20A allow the chin strap 11 to provide skin comfort. An increase in the amount of the second warps 20B will allow the chin strap 11 to be more resistant to stretching under a tensile load.

(2) In the chin strap 11, the second warps 20B are arranged at equal intervals in a direction in which the wefts 11A extend so that the tensile load applied to the chin strap 11 will be even in the extending direction of the wefts 11A. Thus, the tensile load is distributed in a preferred manner by the first warps 20A and the second warps 20B of the warps 11B.

(3) The second warps 20B are more slippery than the first warps 20A. The warps 11B, including the first warps 20A and the second warps 20B, reduce stretching of the chin strap 11 under a tensile load and limit slipping of the chin strap 11 relative to the strap length adjuster 13 when the strap length adjuster 13 is provided. Thus, movement of the strap length adjuster 13 in a direction in which the length of a portion of the chin strap 11 extending out of the second opening 2B increases is restricted if the strap length adjuster 13 slips on the chin strap 11.

The chin strap 11 is sleeve-shaped so that two layers overlap each other in a state separated from each other except at folded portions where the two layers are connected. Force from various directions will be applied to the chin strap 11 when wearing and removing the helmet 1. This will repetitively move one layer relative to the other layer. Repetitive movement of the layers may shift the position of the slide ring relative to the chin strap 11 and increase the length of the portion of the chin strap 11 extending out of the second opening 2B. In this respect, surface area percentages of the first warps 20A and the second warps 20B of the chin strap 11 are set to have a predetermined ratio so that the two layers resist slipping. This restricts movement of the slide ring in a direction increasing the length of the portion of the chin strap 11 extending out of the second opening 2B when the slide ring slips on the chin strap 11.

(4) The slide ring forming the strap length adjuster 13 may be made of a light, high-strength metal material such as stainless steel.

(5) Stretching of the chin strap 11 under a tensile load is reduced by setting the surface area percentage of the second warps 20B in the warps 11B of the chin strap 11 to be greater than 0%.

(6) The static friction coefficient with respect to the slide ring, which forms the strap length adjuster 13, is in a maximum range by setting the surface area percentage of the second warps 20B in the warps 11B of the chin strap 11 to 43.6% or less. When the surface area percentage of the second warps 20B exceeds 43.6%, the static friction coefficient decreases more steeply as the surface area percentage increases, that is, slipping occurs more easily with respect to the slide ring. Thus, the surface area percentage of the second warps 20B is adjusted to 43.6% or less so that the chin strap 11 resists stretching under a tensile load without reducing the static friction coefficient. In this manner, stretching of the chin strap 11 is limited, and slipping of the chin strap 11 with respect to the slide ring is limited.

(7) In addition to the static friction coefficient, the kinetic friction coefficient with respect to the slide ring, which forms the strap length adjuster 13, is in a maximum range by setting the surface area percentage of the second warps 20B in the warps 11B of the chin strap 11 to 23.0% or less. When the surface area percentage of the second warps 20B exceeds 23.0%, the kinetic friction coefficient decreases more steeply as the surface area percentage increases, that is, slipping occurs more easily with respect to the slide ring. Thus, the surface area percentage of the second warps 20B is adjusted to 23.0% or less so that the chin strap 11 resists stretching under a tensile load without reducing the kinetic friction coefficient. In this manner, stretching of the chin strap 11 is limited, and slipping of the chin strap 11 with respect to the slide ring is limited.

The above-described embodiment may be modified as follows.

The surface area percentage of the second warps 20B may be set to be greater than 23.0% or greater than 43.6%. In this case, the chin strap 11 becomes slippery with respect to the strap length adjuster 13. In such a case, the strap length adjuster 13 includes a retention or the like that may be caught in the chin strap 11. As a result, the chin strap 11 resists slipping with respect to the strap length adjuster 13.

The strap length adjuster 13 may be formed by a D-ring or any other tightener instead of the slide ring. The slide ring and the D-ring may be made of metal other than stainless steel or may be a molded component of synthetic resin.

The strap length adjuster 13 may be omitted from the chin strap unit 10. In this case, the length of the chin strap 11 cannot be adjusted. Thus, the length of the chin strap 11 is adjusted in accordance with the wearer before the chin strap unit 10 is attached to the helmet body 2. Further, the chin strap unit 10 that has the specified length is attached to the helmet body 2.

In the chin strap 11, the second warps 20B do not need to be arranged at equal intervals in the direction in which the wefts 11A extend. For example, the chin strap 11, which is tubular-weaved, may include the second warps 20B arranged at equal intervals only on the surface that is opposite to the surface that contacts the skin of the wearer. This limits deterioration in skin comfort caused by the use of the second warps 20B.

In the chin strap 11, which is tubular-weaved, the second warps 20B do not all have to be arranged at different intervals. For example, the second warps 20B may be arranged at equal intervals in the opposing surfaces, and the second warps 20B may be arranged at different intervals, for example, at wider intervals in the folded portions connecting the opposed surfaces. The folded portions may be formed by only the first warps 20A and the second warps 20B may be omitted.

In addition to the first warps 20A and the second warps 20B, the warps may further include third warps, fourth warps, and so on that are formed by different fibers. This allows for adjustment of the strength, stretch resistance, slip resistance, and skin comfort, and the like of the chin strap 11.

In the warps 11B, the amount of the first warps 20A may be less than or equal to the second warps 20B.

The chin strap 11 may be plain-weaved to have the shape of a flat strap instead of being tubular.

The first fibers may be synthetic resin fibers of nylon or the like instead of polyester.

The helmet 1 is not limited to a full-face helmet. The helmet may be a flip-up helmet with a chin portion that can be raised, an open-face helmet, a helmet with a removable chin portion, or a convertible helmet with a chin portion that is pivoted and fixed to the back of the helmet.

The invention claimed is:

1. A helmet, comprising:

a helmet body; and a chin strap arranged at an inner side of the helmet body, wherein the chin strap is woven with wefts and warps to be strap-shaped, the warps include a first warp formed by a first fiber and a second warp formed by a second fiber of ultrahigh molecular weight polyethylene, the second fiber has a higher tensile strength and a higher elastic modulus than the first fiber, and the wefts are each formed by the first fiber.

2. The helmet according to claim 1, wherein the second warp is one of multiple second warps arranged at equal intervals in a direction in which the wefts extend in the chin strap.

3. The helmet according to claim 1, wherein the chin strap includes a strap length adjuster configured to adjust a length of the chin strap.

4. The helmet according to claim 3, wherein the strap length adjuster is made of stainless steel.

5. The helmet according to claim 1, wherein a percentage of a surface area of the second warp in the warps is greater than 0% and less than or equal to 43.6%.

6. The helmet according to claim 1, wherein a percentage of a surface area of the second warp in the warps is greater than 0% and less than or equal to 23.0%.

7. A chin strap arranged at an inner side of a helmet body of a helmet, wherein the chin strap is woven with wefts and warps to be strap-shaped, the warps include a first warp formed by a first fiber and a second warp formed by a second fiber of ultrahigh molecular weight polyethylene, the second fiber has a higher tensile strength and a higher elastic modulus than the first fiber, and the wefts are each formed by the first fiber.

* * * * *